US005130908A

United States Patent [19]

Simon

[11] Patent Number: 5,130,908

[45] Date of Patent: Jul. 14, 1992

[54] ARCHITECTURAL MEMBER COMPRISING ILLUMINATION SYSTEM

[76] Inventor: Jerome H. Simon, 17 Suffolk Rd., Chestnut Hill, Mass. 02167

[21] Appl. No.: 736,694

[22] Filed: Jul. 26, 1991

[51] Int. Cl.[5] ..... F21S 3/00

[52] U.S. Cl. ..... 362/150; 362/300; 362/328; 362/147

[58] Field of Search ..... 362/147, 148, 150, 404, 362/328, 307, 300

[56] References Cited

U.S. PATENT DOCUMENTS 4,463,986 8/1984 Sodder et al. ..... 362/147

*Primary Examiner*—Carroll B. Dority

*Attorney, Agent, or Firm*—Robert P. Cogan; Jerry Cohen; Edwin H. Paul

[57] ABSTRACT

An architectural member that may be installed, for example, in a ceiling contains means for receiving a light source, dividing and distributing light from the source into a number of paths within the member and means for directing the light from the member in each of a plurality of directions.

20 Claims, 4 Drawing Sheets

FIG. 3a
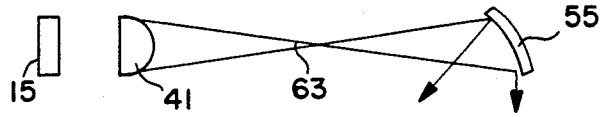
FIG. 3b
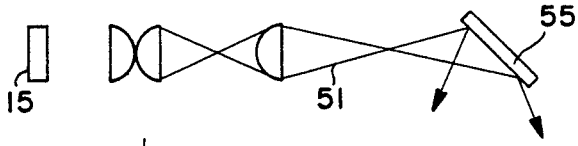
FIG. 3c
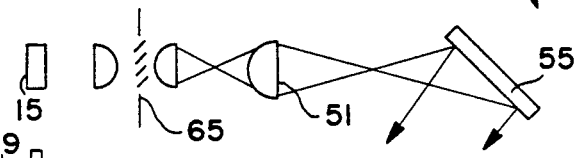
FIG. 3d
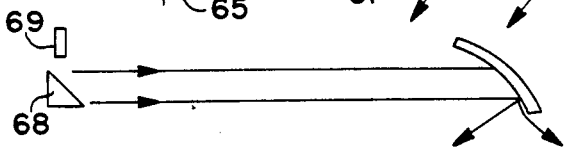
FIG. 3e
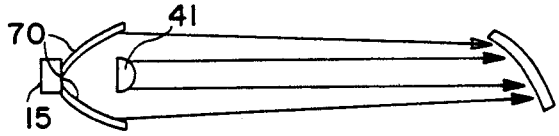
FIG. 3f
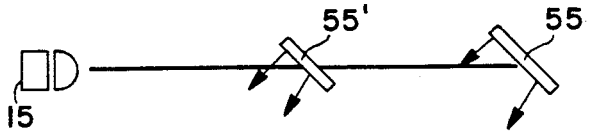
FIG. 3g
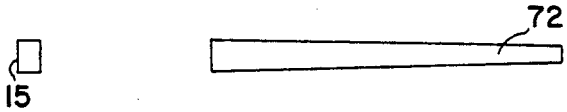
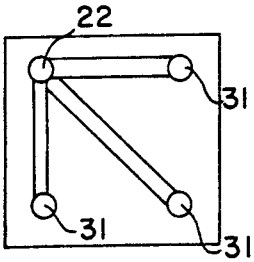
FIG. 4a
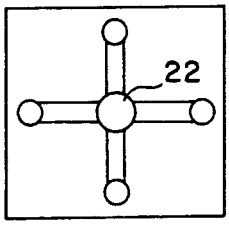
FIG. 4b
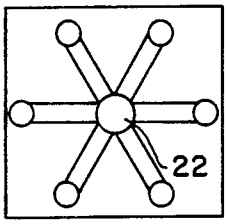
FIG. 4c
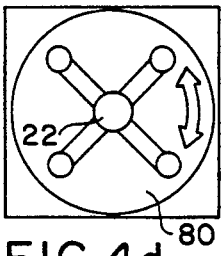
FIG. 4d

ARCHITECTURAL MEMBER COMPRISING ILLUMINATION SYSTEM

BACKGROUND OF THE INVENTION

The present invention relates to illumination systems and more particularly to an architectural member comprising an illumination system.

A significant class of illumination means is the type used for directing light from a ceiling into a room. Many commonly used systems have operating disadvantages sought to be overcome by the present invention. One common form of conventional incandescent light fixture has a substantially cylindrical form, opening into the plane of a ceiling. A bulb is recessed therein. Either a conventional or a spotlight bulb is placed in the fixture as a radiation source. Much of the radiation produced by the source is lost within the fixture due to baffles designed to reduce peripheral glare. The radiation the does get directed out of the fixture is directed with a relatively narrow angular pattern. This results in relatively harsh illumination directly below the fixture. In conventional applications, unless the fixtures are spaced unusually close together there will be dark spots between the fixtures. Harsh shadows can be produced. Such fixtures do not provide broadly distributed light for projection into a space to be illuminated.

Fluorescent fixtures can be used for fairly efficient dispersion of light produced within a fixture. These fixtures comprise holders for tubular bulbs, commonly three or four feet long. Reflectors above the bulbs directly light radially. However, fluorescent lighting is generally nondirectable. It is not suited for sophisticated lighting designs. Such fixtures are physically large. They require large amounts of space. While practical, they are totally unsuitable for sophisticated "designer" applications.

High intensity halogen light bulbs have been employed in prior art light fixtures. They are directable. However, they have been used in downlights either mounted to a ceiling or deeply within it. They cannot be a part of it. They do not serve the purpose of an architectural member.

Neither track lights nor downlights are integrated into a ceiling. Downlights require depth while track lights are intrusive into space.

SUMMARY OF THE INVENTION

It is therefore an object of the present invention to provide an architectural member that includes an illumination system and which can incorporate a highly efficient radiation source.

It is also an object of the present invention to provide an architectural member of the type described in which light is directed from a plane in the architectural member whereby a greater area is covered compared to individual ceiling lamp fixtures such as downlights or fluorescent troughers.

It is an object of the present invention to provide an architectural member of the type described in which radiation is directed therefrom at more than one location so that overlapping cones or beams of radiation tend to eliminate shadows.

It is a more particular object of the present invention to provide an architectural member of the type described wherein radiation from the source is divided and directed into a number of paths, the paths being substantially in registration with a plane defined by the member.

It is an additional object of the present invention to provide an architectural member of the type described including means for mounting in each said radiation path in a modular fashion lenses and other radiation path shaping means.

Is a another object of the present invention in one form to provide an architectural member including the means described above in a unitary member.

It is also a general object of the present invention to provide an architectural member capable of providing different types of illumination, e.g. diffused or reflected, flood or spot from a single light source, wherein a plurality of prior art systems could be replaced by a system comprising one type of architectural member means.

It is a further specific object to provide an architectural member of the type described that may be mounted in a ceiling more simply than a unit comprising a fluorescent fixture, downlights and track lighting.

It is yet another object of the present invention to provide architectural means wherein types or specific placement of illumination may be altered without rewiring.

It is yet another object of the present invention to provide an architectural member of the type described wherein one large lamp may be efficiently used in comparison to a plurality of smaller lamps.

Briefly stated, in accordance with the present invention, there is provided an architectural member comprising means for receiving a source of radiation and for directing a plurality of cones or beams of radiation from the member. A panel defining a plane has means for interfacing said plane to an architectural system. Means in the panel receive a collimatable source of electromagnetic radiation, and means in said panel for dividing said radiation for into separate paths. Collimation means are provided in each paths, preferably mounted in recess means in the panel defining a space for bounding each said path. Directing means at an end of each path for direct radiation away from the panel.

BRIEF DESCRIPTION OF THE DRAWINGS

The means by which the foregoing objects and features of invention are achieved are pointed out with particularity in the claims forming the concluding portion of the specification. The invention, both as to its organization and manner of operation may be further understood by reference to the following description taken in connection with the following drawings.

Of the drawings:

FIGS. 3*a*–3*g* are mechanical schematic illustrations of alternative forms of optical systems for inclusion of each optical path of the embodiment of FIG. 1;

FIGS. 4*a*–4*d* are each a plan view of an alternative form of member illustrating positioning of optical paths in the member;

DESCRIPTION OF THE PREFERRED EMBODIMENTS

Figure 1:
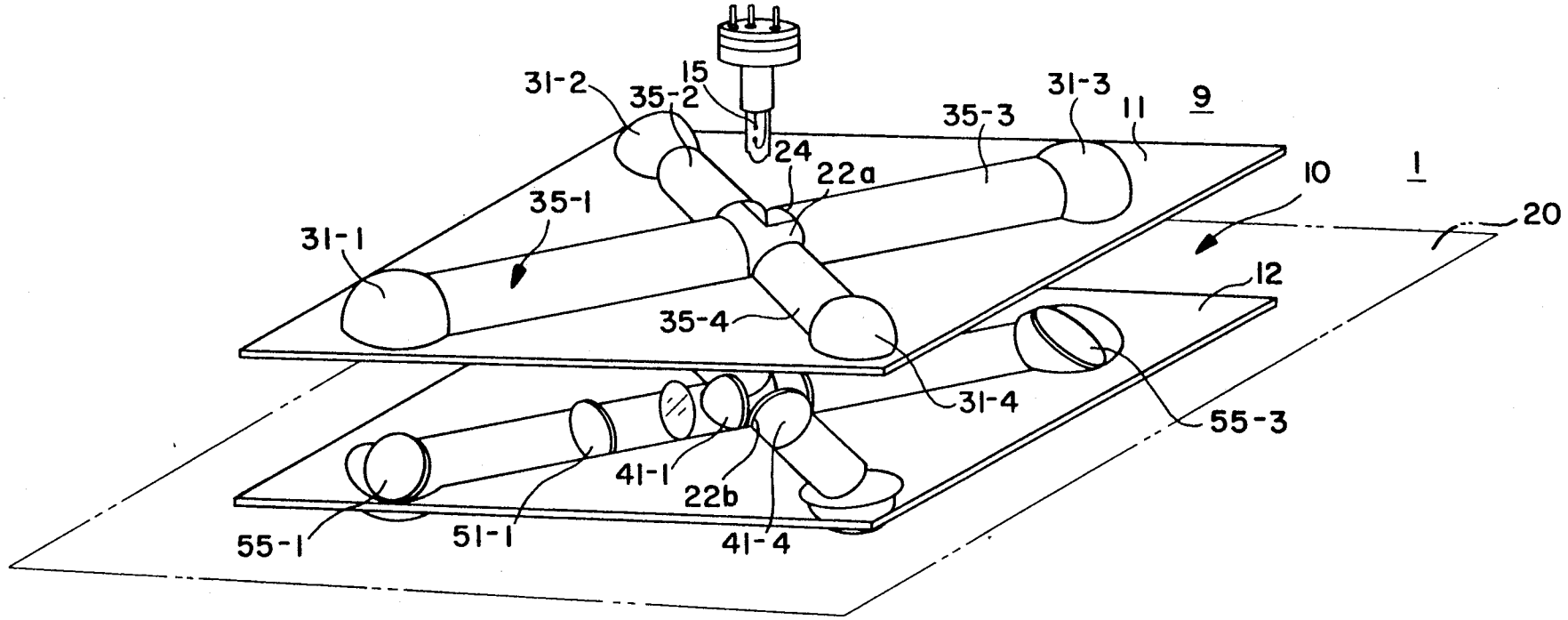
FIG. 1 is an axonometric view in exploded form of a preferred embodiment of the present invention.
Figure 2:
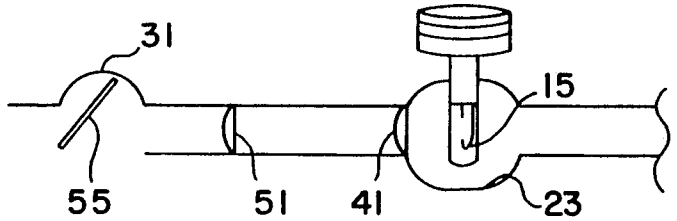
FIG. 2 is a partial, cross-sectional elevation of the embodiment of FIG. 1.

Referring now to FIG. 1, there is illustrated in axonometric and exploded form an architectural member 1 constructed in accordance with the present invention. FIG. 2 is a partial cross-sectional view of FIG. 1 in assembled form in which the same reference numerals are used to denote the same components. Panel means 9 comprise a panel 10 constructed of a lower member 11 and an upper member 12 have complementary mating structures further described below. Alternatively, one member 11 or 12 could be made to embody features for supporting the structures described below and the other could be flat. In further embodiments, as illustrated for example in FIG. 7*a* and 7*b* below the panel means 9 may comprise a plurality of interfacing, optically interconnecting panels.

As another alternative, further described with respect to FIG. 5 below, one member 11 or 12 could be formed to comprise the entire panel 10. A radiation source 15 is provided for mounting in the panel 10. In most embodiments, the radiation source 15 will be a metal halide lamp efficiently providing visible light. However, the radiation source 15 could comprise and infrared or other source. Additionally, the radiation source 15 could comprise refracting means for receiving radiation from an emitting source outside of the panel 10 as described with respect to FIG. 3*d* below.

The panel 10 comprises suitable material for installation in an architectural surface. Commonly, this surface will be a ceiling. Suitable materials include glass, Lexan polycarbonate resin, or opaque panel material. Most conveniently, the material will be moldable. The panel 10 is preferably flat over the portions which do not require the presence of other structure for the purposes described below. "Flat" is used in the qualitative sense to denote a panel 10 that will fit in an architectural surface. Of course, it will have thickness, and flatness in the sense of an optical flat is generally unnecessary. The panel 10 in the embodiment of FIG. 1 is square, but may be of substantially any shape.

The panel 10 defines a plane 20. In most embodiments, the plane 20 will coincide with the flat portions of the panel 10. The edges of the panel 10 comprise means for interfacing the plane 20 to an architectural system. Typically this will be achieved in a system in which a suspended grid supports ceiling tiles. The panel 10 may be mounted in such a system, and the edges of the panel 10 will rest on T-bar members of a ceiling system. The plane 20 will comprise center lines for the optical paths described below and will include an entrance for radiation from the source 15 to these optical paths in this embodiment. Alternatively, the plane 20 may be parallel to a plane including the optical path center lines.

In the description of the portions of the upper and lower panel members 11 and 12 and the structures formed thereby when they mate to comprise the panel 10, an a suffix to a reference numeral refers to a portion of the panel member 11, and a b suffix refers to a corresponding portion of the panel member 12. The same reference numeral without a suffix denotes the structure formed by the mated a and b components. The reference numeral also denotes the a and b portions collectively. The descriptive device is utilized to avoid undue repetition. Hemispherical walls 22*a* and 22*b* are centered in the panels 11 and 12 respectively and mate to define a central chamber 22. The wall 22*a* has an aperture 24 formed therein so that the central chamber 22 may receive a collimatable source of electromagnetic radiation. The upper wall 22*a* is preferably reflective. The lower wall 22*b* may include an aperture 23 (FIG. 2) so that a downlighting function may also be provided from the architectural member 1.

The source may be the radiation source 15 centered in the central chamber 22, or it may be means directing radiation from a source outside of the panel 10 to the plane 20. In this manner, the architectural member of the present invention may be retrofitted to installations comprising prior art downlights. This can change the kind of light from a source, e.g. from a downlight spotlight to multiple beams and/or a broad distribution from the original lamp.

In the embodiment of FIG. 1, four orthogonal optical paths are provided from the chamber 22 to each of four radiation exit chambers 31-1 through 31-4, formed adjacent corners of the panel 10 and each having a substantially spherical outline. The convention will be used in the present description of using the same reference number for each of corresponding elements in similar multiple paths. Thus the numeral 31 may describe any of the chambers 31-1 through 31-4, and elements with the same suffix will comprise portions of the same subassembly. For ease in description, elements may be referred to with or without a suffix since in preferred embodiments, each subassembly will function identically. However, this is not a necessity. As described with respect to FIG. 8, for example, while subassemblies will each direct light from the radiation source 15, to an exit chamber 31, this function can be done in a different manner in each subassembly. Also, the present description describes embodiments of any number of paths. If symmetrical arrangement were desired and the chambers 31 were circumferentially spaced with their axes 72° apart rather than 90° apart, then chambers 31-1 through 31-5 would be provided.

In the present embodiment, the exit chambers 31-1 through 31-4 are joined to the central chamber 22 by cylinders 35-1 through 35-4 respectively. In the embodiment of FIG. 1, the chambers 31-1 through 31-4 and cylinders 5-1 through 35-4 are symmetrical with respect to the plane 20, but this is not necessary. In order to most efficiently direct radiation from the source 15 to the exit chambers 31-1 through 31-4, means in are provided in the panel 10 for dividing radiation for direction into separate paths, preferably all lying within the cylinders 35-1 through 35-4. The cylinders 35 each define recess means in the panel 10 defining a space for bounding optical each optical path. The dividing means into each of these optical paths could simply comprise the intersections of each cylinder 35 with the central chamber 22. However, this would result in not maximizing use of radiation from the source 15.

In the preferred embodiment, in the intersection of the chamber 22 with each cylinder 35, a condenser lens 41-1. 41-2. 41-3 or 41-4 is positioned. The condenser lenses 41-1 through 41-4 are each placed at the intersection of the central chamber 22 with the cylinders 35-1 through 35-4 respectively. The condenser lenses 41 may each comprise multiple elements, including elements axially displaced from each other. In the present description, the axial direction refers to an axis of a particular one of the cylinders 35. Collimation means are provided to collimate radiation in each of said paths. Collimation lenses 51-1 through 51-4 are provided to receive radiation from each of the condenser lenses 41-1 through 41-4 respectively. Each collimation of the lenses 41-1 through 41-4 is placed between on of the condenser lenses 41 and the exit chambers 31-1 through 31-4 respectively. While the cylinder 35 is a preferred form of optical path means, the optical path need not necessarily be an enclosure. An example is discussed with respect to FIG. 8 below.

At the end of each optical path are directing means for directing radiation away from the panel. Positioned in each of exit chambers 31-1 through 31-4 is a reflecting means which may comprise a mirrors denoted 55-1 through 55-4 respectively. The reflecting mirrors 55 may be fixed or movable. Light may be directed through an exit aperture 61 in each of the chambers 31. Many different forms of mirrors 55 may be provided depending on the manner in which is desired to direct radiation. These alternatives are discussed further with respect to FIG. 3 below.

FIG. 3, comprising FIGS. 3*a* through 3*g*, is an optical schematic diagram of the optical path from the radiation source 15 to any of the exit chambers 31-1 to 31-4. Various forms of optical components are illustrated. FIGS. 3*a*–3*g* are alternate forms of the same optical path, and are represented with a common horizontal axis. In FIG. 3*a*, A plano-convex condenser lens 41 is provided directing radiation to a mirror 55 having opposite concave and convex surfaces. The mirror 55 may be pivotable so that either the convex or concave surface may be used to direct radiation out of the system. In this embodiment, the collimating means comprises the condenser lenses 41. In FIG. 3*b*, the condenser lenses 41 each comprise a square Fresnel lens which directs radiation to the collimating lens 51 to focus radiation on a plane mirror 55.

In the embodiment of FIG. 3*c*, a pattern gate 65 is included in a focal plane intermediate first and second elements of a double condenser lens 41 each comprising a circular convex lens. The pattern gate may contain either intelligence or a decorative pattern. The image of the pattern is projected onto the mirror 55 which may reflect the decorative pattern or discernible intelligence, such as a word onto surfaces in a room.

In FIG. 3*d*, the radiation source 15 comprises a refracting means, a prism 68, in registration with a lamp in the nature of a point source. The prism 68 directs radiation input to each optical path. This embodiment is suitable for retrofitting to prior art downlight systems since the panel 10 is vertically displaced from the lamp 69.

FIG. 3*e* illustrates a plano-convex condenser lens 41 displaced from the intersection of the chamber 22 and cylinder 35, which intersection is surrounded by a reflector 70. The reflector 70 directs light in to each optical path which would otherwise be radiated onto walls of the cylinder 35.

In the embodiment of FIG. 3*f*, first and second reflecting mirrors 55 and 55, are respectively included in exit chambers 31 and 31' along a single optical path. The mirror 55' is a beam splitting mirror intermediate the radiation source 15 and the mirror 55.

In the embodiment of FIG. 3*g*, the directing means in the exit chamber comprises an elongated lineal beam distributing device 72, rather than a mirror 55, for directing a rectangular light pattern from an elongated exit chamber 31. An example of such a device is found in my copending patent application 07/552,904—now U.S. Pat. No. 5,046,805.

FIG. 4 is a simplified plan view of four alternative forms of the panel 10 illustrated in FIGS. 4*a*–4*d*. The same reference numerals describe corresponding components. FIG. 4*a* illustrates that the optical paths need not be symmetrically arranged. The central chamber 22 is located adjacent a corner of the panel 10, and the chambers 31 are located adjacent other corners. In the embodiment of FIG. 4*b*, The chambers 34 are located adjacent centers of sides of the panel 10 rather than corners thereof. In the embodiment of FIG. 4*c*, six optical paths in cylinders 35 are provided and six chambers 31 are positioned to define a hexagonal outline. In the embodiment of FIG. 4*d*, a rotatable plate 80 is formed in the panel 10 to be rotatable, so the entire optical system of a panel 10 is rotatable.

Figure 5:
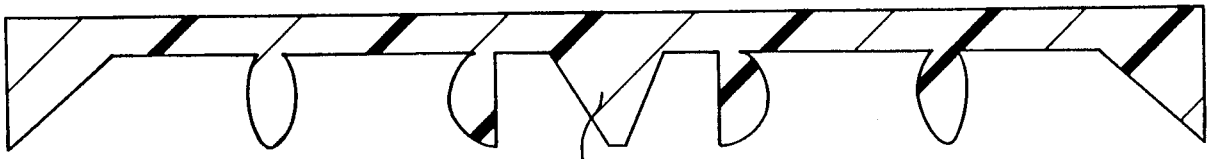
FIG. 5 is an elevation of a further form of panel embodying the present invention.

FIG. 5 is a cross-sectional elevation of a panel 10 comprising a unitary molded piece. In the embodiment of FIG. 5, the radiation source 15 takes on the above-described form of refracting means 68 for directing radiation from an emitter outside the panel 10 to the optical paths.

Figure 6:
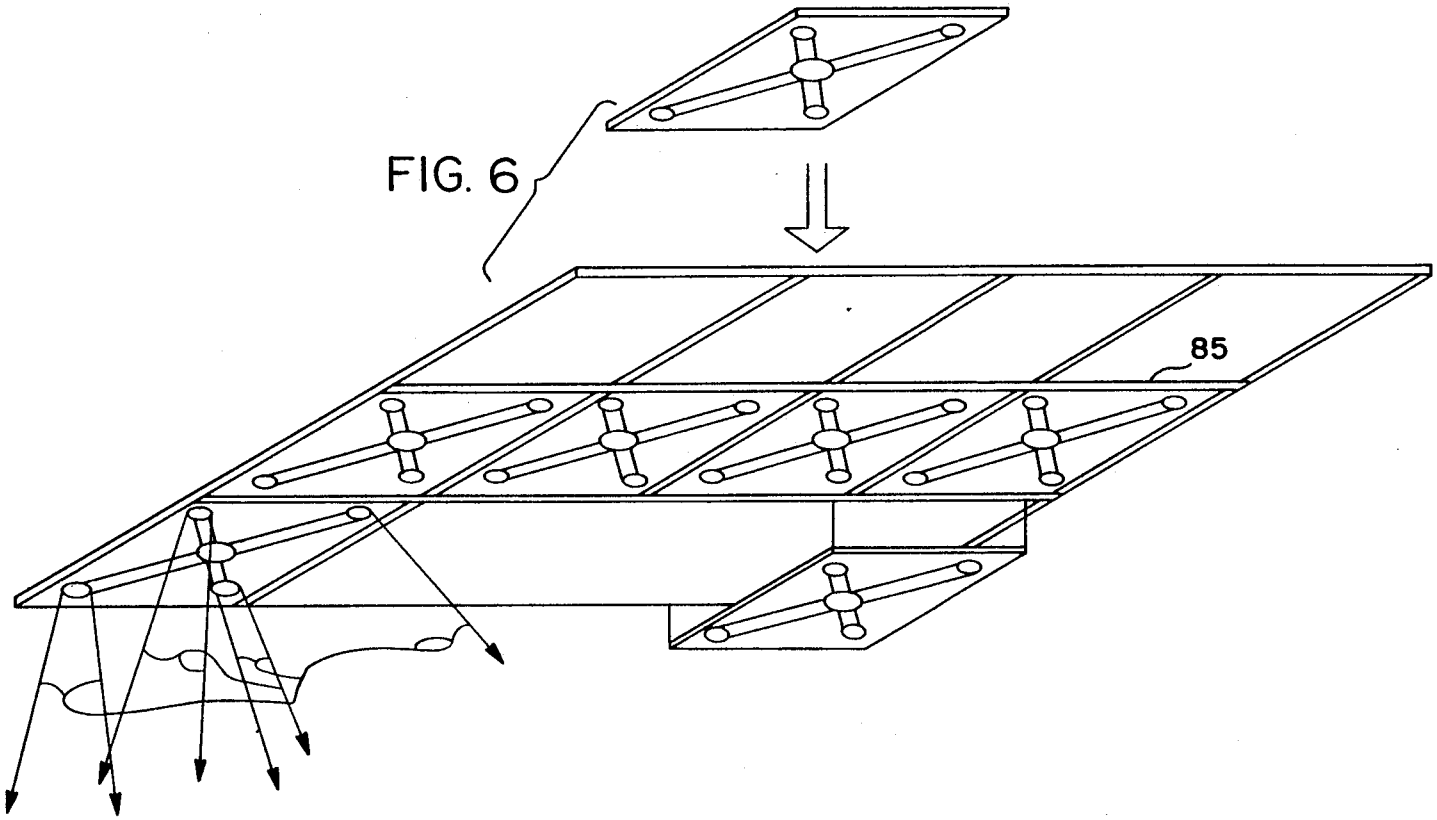
FIG. 6 is an axonometric view of a system embodying a plurality of members in accordance with the present invention.

FIG. 6 is an axonometric view of a system embodying a plurality of members in accordance with the present invention. Support ribs 85 form a grid forming squares that may each support a panel 10. Alternatively, a panel 10 may be placed in each of selected squares and other squares may be filled with ceiling tile or other opaque means. In most embodiments, the ribs 85 will comprise well-known T-bars. However, the ribs 85 could be formed to include optical paths. The ribs 85 thus configures would comprise panel means 9.

Figure 7A:
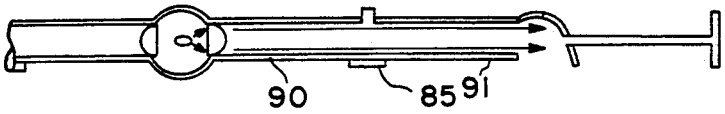
FIGS. 7*a* and 7*b* are each a cross sectional view of a further embodiment of directing means and panel means.
Figure 7B:
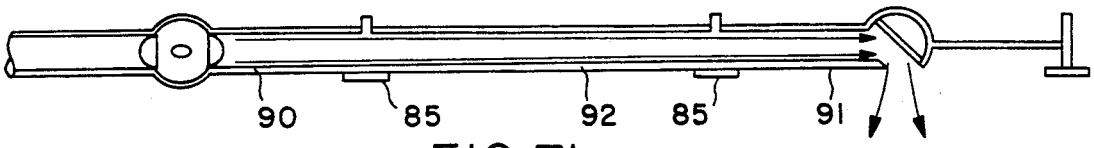

As stated above, the panel means 9 may comprise more than one panel 10. FIGS. 7*a* and 7*b*, which are cross sectional illustrations illustrate embodiments in which panel means 9 comprise a plurality of discrete panels. In the embodiment of FIG. 7*a*, a first discrete panel 90 comprising the chamber 22 housing the radiation source 15 and mates with a panel 91 comprising the exit chamber 31. The panels 90 and 91 are supported at their interface by a rib 85.

In the embodiment of FIG. 7*b*, a panel 92, supported at each end by a rib 85, is supported intermediate the panels 90 and 91 and comprises a light conveyance panel comprising an axially central portion of the cylinder 35. Directing means 55 in each panel 91 do not have to define a plane coplanar with the plane defined by the panel 90.

Figure 8:
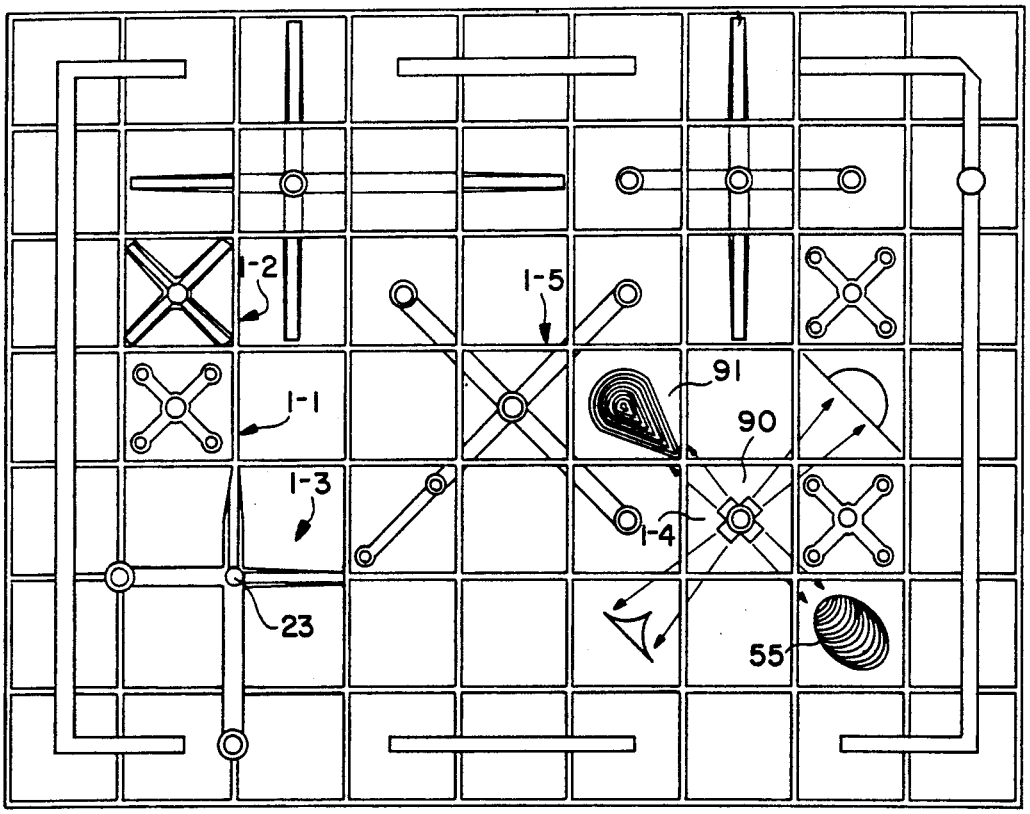
FIG. 8 is a plan view of a system comprising a plurality of panel means.

FIG. 8 is a plan view illustrating an illumination system comprising a plurality of architectural members 1. In such a system combinations of embodiments described above are provided. For example, architectural member 1-1 may comprise optical paths according to FIG. 3*a* to provide a plurality of spotlights. The architectural member 1-2 may include optical paths according to FIG. 3*g* to provide lineally diffused or projected lighting. The architectural members 1-1 and 1-2 provide different types of illumination. However, each has the same wiring requirements. Therefore, the present invention allows for interchangeability of different types of illumination for the same wiring.

Architectural member 1-3 comprises panel means 9 formed in ribs 85. Different optical paths within the same architectural member may provide different types of illumination.

In member 1-4, optical path means do not comprise an enclosure. Each optical path is defined by the relative positioning of a panel 90 and respective panels 91-4 through 91-4.

In member 1-5, one optical path comprises a path according to FIG. 3*f*. Fresnel reflectors or non planar mirrors 55 can be used.

What is thus provided is an architectural member which may be provided to diffuse light within a space. Modularity is thus provided. The specification has been written with a view toward enabling those skilled in the art to make many departures from the specific embodiments illustrated to provide an architectural member constructed in accordance with the present invention.

What is claimed as new and desired to be secured by Letters Patent of the United States is:

1. An architectural member comprising:

a) panel means having a plane and means for interfacing said plane to an architectural system;

b) means in said panel means for receiving a collimatable source of electromagnetic radiation;

c) means in said panel means for dividing said radiation for direction into separate paths each substantially in the plane;

d) collimation means in said panel means for collimating radiation in each of said paths;

e) optical path means in said panel means defining a space for bounding each said path; and f) directing means at an end of each path for directing radiation away from said panel means.

2. The member according to claim 1 wherein said optical path means comprises a first recess in said panel means.

3. The member according to claim 2 wherein said panel means includes an aperture for receiving said radiation source and means for maintaining said radiation source disposed to emit radiation into said paths.

4. The member according to claim 3 wherein said means for dividing comprises a plurality of condenser lenses surrounding said radiation source.

5. The member according to claim 4 wherein said collimation means for collimating radiation in each of said paths comprises a condenser lens.

6. The member according to claim 5 wherein said means for directing comprises a reflecting surface positioned to receive radiation in one said path and reflecting radiation therefrom.

7. The member according to claim 5 wherein said means for directing comprises lineal beam diffusing means.

8. The member according to claim 6 wherein said radiation source comprises a lamp positioned for emitting radiation in said plane.

9. The member according to claim 6 wherein said radiation source comprises reflecting means for reflecting radiation from a lamp mounted in a position displaced from said plane.

10. The member according to claim 8 wherein said means for collimating comprises a second recess in said panel for supporting said lenses in each said path.

11. The member according to claim 10 wherein said radiation source comprises a metal halide lamp.

12. The member according to claim 10 wherein each lens and each said reflecting means comprises a portion integrally molded with said panel.

13. The member according to claim 11 wherein four said condenser lenses disposed to define a square surrounding said radiation source and four said paths are provided, each substantially perpendicular to the adjacent said path.

14. The member according to claim 10 wherein said lenses comprise circular convex lenses.

15. The member according to claim 10 wherein said lenses comprise square Fresnel lenses.

16. The member according to claim 10 wherein said second recess defines a path parallel to said plane.

17. The member according to claim 1 wherein said panel means comprises a plurality of discrete panels.

18. The member according to claim 1 wherein said panel means comprises rib means capable of supporting other panels.

19. An illumination system comprising a plurality of architectural members according to claim 1, each member for providing a selected type of illumination.

20. A system according to claim 19 wherein selected panel means are formed to provide differing selected types of illumination.

* * * * *